US006112681A

United States Patent [19]

Adcox

[11] Patent Number: 6,112,681

[45] Date of Patent: Sep. 5, 2000

[54] TUFTING MACHINE HAVING A PUSH ROD SEAL SYSTEM

[76] Inventor: W. Clifford Adcox, P.O. Box 1244, Dalton, Ga. 30722-1244

[21] Appl. No.: 09/404,087

[22] Filed: Sep. 23, 1999

[51] Int. Cl.[7] ..... D05B 71/00; D05C 15/10

[52] U.S. Cl. ..... 112/80.4; 112/256; 184/6.15; 184/6.18

[58] Field of Search ..... 112/80.4, 80.01, 112/256, 43; 384/139, 140; 184/6.15, 6.18

[56] References Cited

U.S. PATENT DOCUMENTS 4,522,136 6/1985 Wolff et al. ..... 112/256

4,545,312 10/1985 Ingram ..... 112/256

*Primary Examiner*—Peter Nerbun

*Attorney, Agent, or Firm*—Alan Ruderman; Stephen J. Stark

[57] ABSTRACT

A tufting machine has a head, including a plurality of push rods reciprocably driven through push rod seals having a housing connected to the head of the tufting machine. The push rod seals include a driver connected to and moveable relative to the housing, a stack of oil seals is located between the driver and a ledge within the housing. A pressure bearing is located between the oil seals and the housing and the driver respectively. The push rod seal system allows for reciprocatory movement of the push rods therethrough while preventing oil leakage past a reciprocating push rod.

15 Claims, 3 Drawing Sheets

TUFTING MACHINE HAVING A PUSH ROD SEAL SYSTEM

BACKGROUND OF THE INVENTION

This invention relates to tufting machines and more particularly to a tufting machine having a push rod oil seal system where the push rod exits at the head of the tufting machine.

In the production of tufted fabrics, a plurality of spaced yam carrying needles extend transversely across the machine and are reciprocated cyclically to penetrate and insert loops of yam into a backing material fed longitudinally beneath the needles. The loops are seized by loopers or hooks oscillating below the fabric in timed relationship with the needles as the loopers or hooks cross the needles just above the needle eye. In loop pile machines, the loopers point in the direction in which the backing material is being fed, hold or seize the loops while the needles are being retracted from the backing, and thereafter move away from the point of seizure to release the loops. In cut pile machines, the hooks point in a direction opposite to the direction in which the backing material is being fed so the loops are fed onto the hooks and each hook cooperates with a respective oscillating knife. Since the loops are fed toward the closed end of the hook, they cannot be released except by being cut by the respective knife. As the hooks rock away from the point of loop seizure, the knife rocks upwardly and cuts the loop. During each penetration of the backing material a row of pile is produced transversely across the backing material. Successive penetrations result in a longitudinal row of pile produced by each needle.

Tufting machines typically comprise a head to which is secured a plurality of collars connected to a sleeve. Journally disposed for reciprocation within each sleeve is a push rod. Attached to the lower end of the push rod is a needle bar carrier which in turn supports a needle bar which in turn supports a needle bar extending transversely of the machine and which carries a multiplicity of downwardly depending needles. The upper end of each push rod may be connected by a wrist pin or the like to a link which in turn may be connected by another wrist pin to a rocker arm which is in turn clamped to an oscillating main shaft so that rocking motion applied to the shaft results in reciprocation of the needle bar and thus the needles. Alternatively the main shaft may be rotated and drives an eccentric or the like connected to drive the push rods. Other driving mechanisms known in the art may also be utilized. Corresponding hooks or loopers are driven respective to the needles to receive loops of the yarn from the needles. A knife may cooperate with each respective hook for cutting the loops of yarn seized thereby.

Where the push rod reciprocates relative to the sleeve is a source of oil leaks in substantially most tufting machines. Prior art sealing systems utilize a leaded or leaded bronze bearing in conjunction with an oil seal. Prior art oil seals typically have a sharp lip which pushes oil back up into the head of the machine in an attempt to prevent the oil from leaking past the seal down the push rod onto the needle bar, and onto the backing material. Oil seals are typically made of some type of synthetic rubber or felt material, or a combination thereof. A cap is often utilized in conjunction with the oil seal. The cap may hold an oil ring to assist the oil seal in retaining the oil in the head of the tufting machine. Once an oil seal is installed, it typically cannot be adjusted.

Leakage of oil past the collar along the push rod has always been and is a continuing problem in the tufting machine art. A sliding projection, or imperfection, on the push rod shaft may result in oil leakage. Push rod travel outside the reciprocation direction may result in leakage past the push rod seal. Damage to the oil seal during installation may result in oil leakage. Excessive oil seal wear may result in leakage. Imperfections in the oil seal may result in leakage. Excessive play in push rod connections may result in leakage. Additionally, many times a prior art sealing arrangement may be replaced with a new seal arrangement only to have the push rod continue to leak past the seal.

Accordingly, the prior art has not solved successfully the problem of oil leakage past the push rod during tufting machine operation and oil seal leakage continues to plague the tufting industry. For example, in Ingram, U.S. Pat. No. 4,545,312, one proposal was made to solve the problem. Nevertheless, the problem persists.

SUMMARY OF THE INVENTION

Consequently, it is a primary object of the present invention to significantly reduce, if not eliminate, oil leakage past the push bars in tufting machines.

It is another object of the present invention to provide an improved push rod seal system.

A further object of the present invention is to provide a push rod seal system wherein the seal may be adjusted after installation.

Accordingly, the present invention provides a push rod seal system wherein a collar connectable to the head of a tufting machine is connected to a supporting sleeve to form a housing, at least one pressure bushing and a plurality of oil seals being located within the sleeve. A driver connected to the sleeve is utilized to adjust the compression on the oil seal within the assembly. Furthermore, the driver may be fixed at a desired position relative to the housing.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
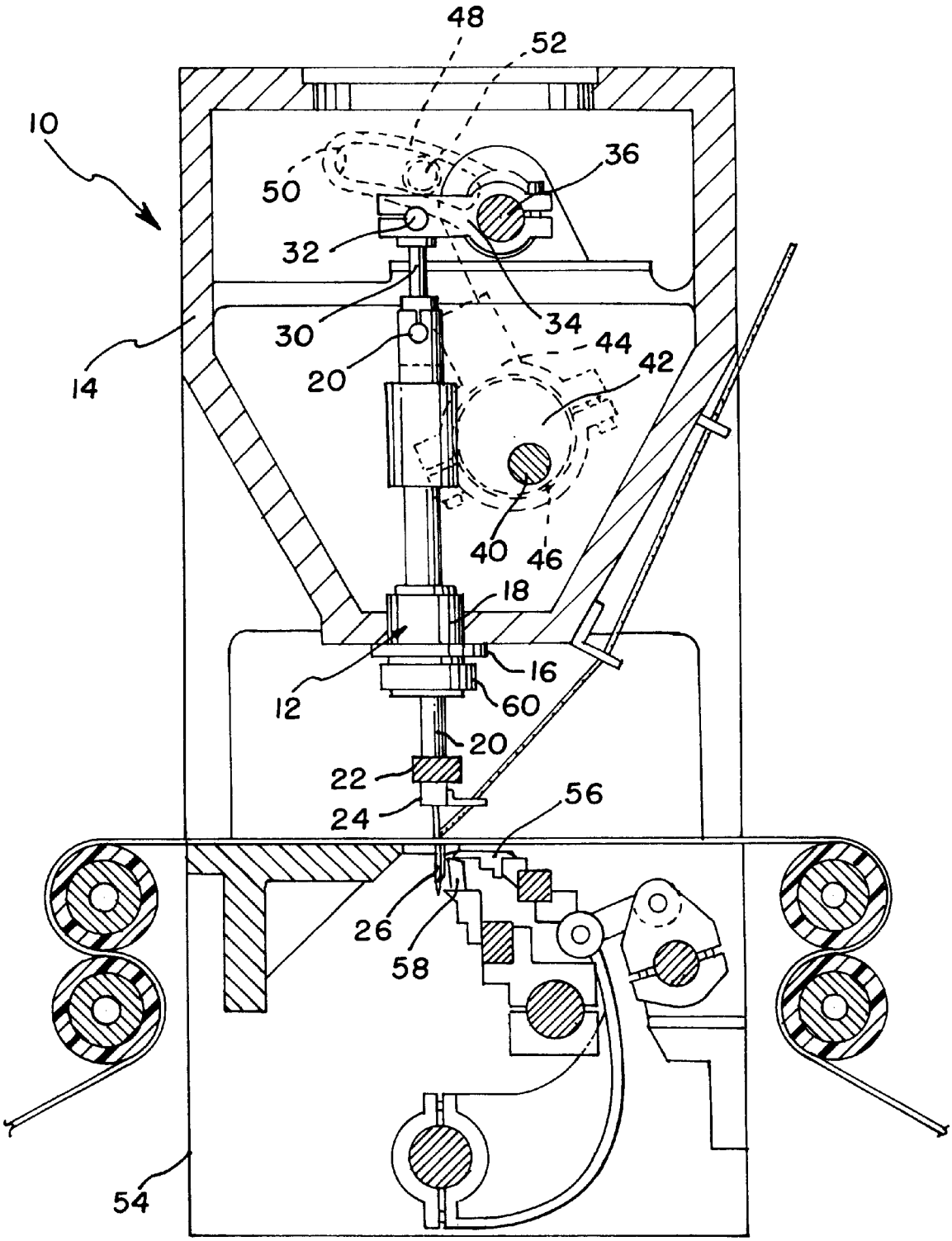
FIG. 1 is a vertical sectional view adjacent one end of a tufting machine incorporating a push rod seal system in accordance with the principles of the present invention.

Referring now to the drawings, FIG. 1 illustrates a tufting machine 10 utilizing the push rod seal system 12 constructed in accordance with the present invention.

Tufting machines typically have a head 14 within which is secured a plurality of collars 16, only one of which is illustrated, for supporting respective sleeves 18, the collar 16 and sleeve 18 preferably comprising portions of the push rod seal system 12.

Journally disposed for reciprocation within each sleeve is a push rod 20. Attached to the lower end of the push rod 20 is a needle bar carrier 22 which in turn supports a needle bar 24 extending transversely of the machine 10 and which carries a multiplicity of downwardly depending needles 26. The upper end of each push rod 20 is illustrated connected by a wrist pin or the like 26 to a link 30 which is in turn connected by another wrist pin 32 to a rocker arm 34 which in turn is clamped to an oscillating main shaft 36 so that rocking motion applied to the shaft 36 results in reciprocation of the needle bar 24 and thus the needles 26. Another conventional method for reciprocating the needles 26 includes the use of an eccentric. Other methods of reciprocating the needles are well known in the art.

Oscillating motion is typically applied to the main shaft 36 through means including a cam shaft 40 mounted in the head 14 below and substantially parallel to the main shaft 36 and driven at one end of the machine 10 in a conventional manner. A circular eccentric cam 42 may be secured preferably adjacent each end of the cam shaft 40 and rotates therewith. A connecting rod 44 having a lower split end section is illustrated journaled on a sleeve 46 on the eccentric cam 42. The upper end of the connecting rod 44 is connected in a slotted or arcuate lever arm 48 of a drive lever secured at one end to the main shaft 36. A slot 50 within the arm 48 has an arcuate path having a center of curvature coinciding with the geometric center of the eccentrically mounted cam 42 when the cam is at bottom dead center. Thus, the stroke of the push rods 20 may be adjusted and this may be accomplished without changing the bottom position of the needle stroke. Accomplishing this merely involves repositioning a bolt 52 connecting the connecting rod 44 to the drive lever 48 within the slot 50 which changes the amplitude of oscillation of the lever and affects the change in amplitude of the rocking of the main shaft 36 as is well known in the art. Other tufting machine designs may be known in the art as well which have a push rod 20 exiting the head 14 through a push rod seal system 12.

Mounted in the bed 54 of the tufting machine and driven in timed relationship with reciprocation of the needles 26 is a plurality of hooks or loopers 56 corresponding in number to the number of needles 26 for seizing loops of yam from the needles 26. A knife 58 may cooperate with each respective hook 40 mechanism heretofore described.

Many improvements have been made to the basic design of a tufting machine 10. However, almost every tufting machine 10 utilizes a head 14 wherein a push rod 20 connects with the needles 26 to a main shaft 36 in some fashion. A push rod seal system 12 is utilized to attempt to retain oil within the head to keep oil from leaking onto carpet backing or other tufted textile near where the push rod 20 passes through the head 14.

Figure 2:
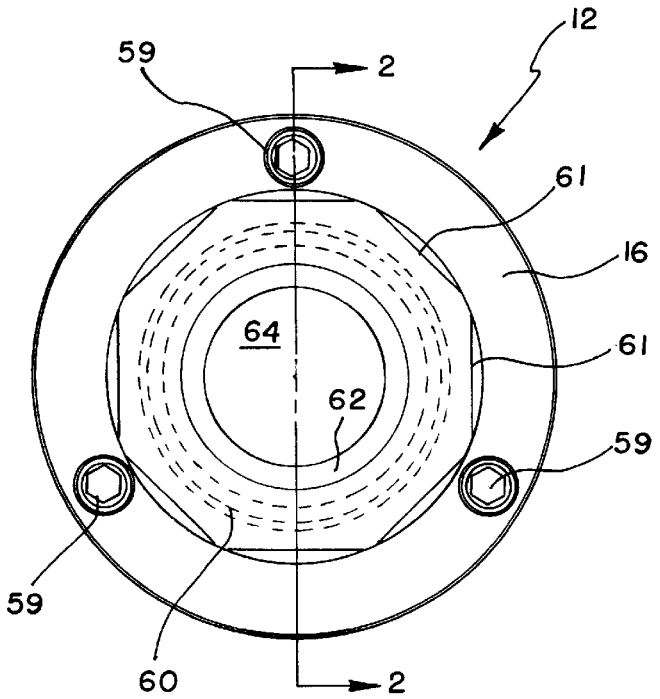
FIG. 2 is a bottom elevational view of the preferred form of the push rod seal system removed from the tufting machine.

In accordance with the present invention, the details of the push rod seal system 12 are illustrated in FIGS. 2–5. FIG. 2 is a bottom view of the push rod seal system 12 shown removed from the tufting machine 10. The collar 16 is shown with three screws 59 used to attach the collar 16 to the head 14. Other attachment mechanisms and/or devices may also be utilized to attach the collar 16 to the head 14 as are known in the art. The collar 16 is shown as being substantially round, however, other configurations may also be utilized depending on the particular head 14 and collar 16 interface.

A nut or driver 60 is connected and movable relative to the collar 16. The driver 60 may have a plurality of faces 61 for accepting the jaws of a wrench in order to move the driver 60 relative to the collar 16.

The driver 60 may receive and assist in supporting a pressure bushing 62 which may form a part of the push rod seal system 12. An opening 64 is provided for the push rod 20 to reciprocate therethrough.

Figure 3:
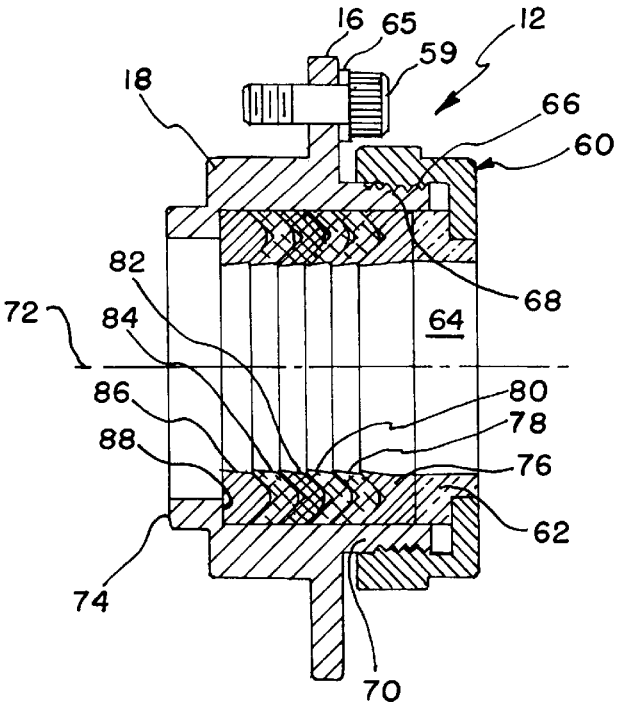
FIG. 3 is a fragmentary cross sectional view taken substantially along the lines 2—2 of FIG. 2.

FIG. 3 is a cross sectional view of the push rod seal system 12 with the push rod 20 removed. A single screw 59 is illustrated, however, multiple screws or other attachment devices may also be utilized to connect the push rod seal system 12 to the head 14. The screw 59 is illustrated passing through a portion of the collar 16 and may use a lock washer 65 to remain in place. Other attachment arrangements may, or may not, utilize a portion of the collar 16. The collar 16 is shown integrally connected to the sleeve 18, however, this need not necessarily be the case. The driver 60 is preferably connected at threads 66 with threads 68 of throat 70. In this manner, the driver 60 is movable relative to the collar 16. Rotating the driver 60 relative to the throat 70 will result in the movement of the driver along the axis 72 of the seal system 13. Other methods known in the art may also be utilized to move the driver 60 relative to the throat 70 or other portion of the push rod seal system 12. The pressure bushing 62 is illustrated having at least a portion concentrically within the driver 60. The driver 60 may move the pressure bushing 62 relative to the collar 16 as it is moved.

The driver 60, when moved along the axis 72 towards the collar 16, will preferably move the pressure bushing 62 towards a distal end 74 of the sleeve 18. The movement of the pressure bushing 62 may assist in compressing oil seals 76, 78, 80, 82, 84, 86. In the preferred embodiment, the driver 60 acts upon pressure bushing 62 to compress oil seals 76, 78, 80, 82, 84, 86 between the pressure bushing 62 and an annular ledge 88 within the sleeve 18. When the driver 60 is moved towards the seals 76–86, at least some of the oil seals 76, 78, 80, 82, 84, 86 will compress such that the cross sectional area of the opening 64 is reduced or at least some of the seals 76–86 will tighten about the push rod 20. By reducing the cross sectional area of the opening 64, or tightening about the push rod 20, less opportunity is provided for which oil may leak past a push rod 20.

In the preferred embodiment, a female oil seal 76 is positioned adjacent to the pressure bushing 62. Next to the female oil seal 76 is located at least one, and preferably two, homogeneous Vee oil seals 78, 80, the female seal having a configuration for receiving the Vee shape of the adjacent seal. Next to the one or two homogeneous Vee oil seals is located a Vee oil seal 82. Next to the oil seal 82 is located another homogeneous Vee oil seal 84. Finally, a male oil seal 86 is located adjacent the ledge 88. Other oil seal arrangements may be utilized depending upon the application.

It is preferred that some of the oil seals 76–86 be constructed of the polyurethane homogeneous material, such as oil seals 78, 80, and 84. This pliable material has been found to be effective at creating an oil seal with the push rod 20. The seals which are not constructed of the polyurethane material are typically impregnated cord type material which is somewhat akin to an automobile tire.

Figure 4:
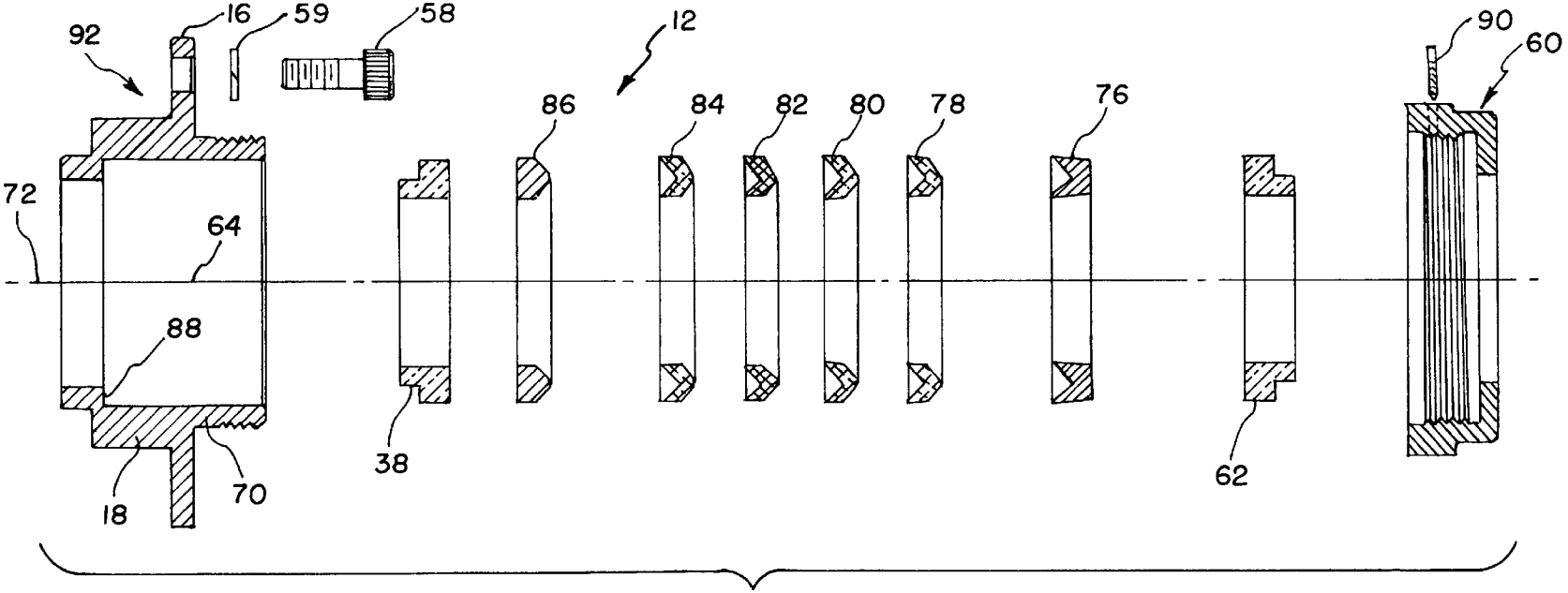
FIG. 4 is an exploded view of an alternate form of the push rod seal system illustrated in FIG. 3.

Additionally, as illustrated in FIG. 4, a second pressure bushing 38 may, if found desirable, be utilized adjacent to ledge 88 in an alternative embodiment. In that case, a pressure bushing 38, preferably identical to the one utilized adjacent to the driver 60, is reversed 180° and inserted adjacent to the ledge 88. In this manner, pressure bushings 62, 38 are provided both on the inlet and the outlet of the pressure seal system 12. The pressure bushings 62, 38 are preferably constructed of a bronze material, however, brass or other materials could also be utilized. This is necessary to prevent lateral movement of the push rods when using resilliant seals. Bronze is preferred in that it has shown better characteristics under higher temperatures than brass.

FIG. 4 is an alternatively preferred embodiment of the pressure seal system 12 shown in an exploded view. Two pressure bushings 62, located at both ends of the pressure seal system 12, are used.

In addition to using two pressure bushings 62 in the alternatively preferred embodiment, FIG. 4 illustrates the assembly of the pressure seal system 12. If used, one pressure bushing 38 is installed against the ledge 88. Next, the male oil seal 66 is installed followed by the V oil seal 78, 80, 82, 84, homogeneous or otherwise. Next is the female oil seal 76 which is followed by the pressure bushing 62. Finally, the driver 60 is preferably screwed onto the throat 70 of the housing 92 so that the driver 60 moves relative to the housing 92. At a certain point, the driver will compress at least one of the oil seals 76–86. The housing 92 is preferably made up of the throat 70, the collar 16 and the sleeve 18. FIG. 4 also illustrates the use of a lock bolt 90 in the driver 60 which may be utilized to fix the position the driver 60 relative to the housing 92. The lock device 90 may be in the form of a screw, as illustrated, or may be some other type of locking device as it is known in the art. Additionally, a plurality of locking devices 90 may be utilized.

The housing 92 is preferably made of steel material. The driver 60 is preferably made of the same steel material. The pitch of the screw threads 66, 68 has been found effective to be 16 per inch in order to provide the user adequate control of adjusting the compression of one or more of the oil seals 76, 78, 80, 82, 84, 86; however, other thread pitches could also be utilized. The tolerances which have been found to be acceptable are within 5/1000 of an inch within the inner diameter; however, depending upon the particular application, other tolerances may also be acceptable.

Figure 5:
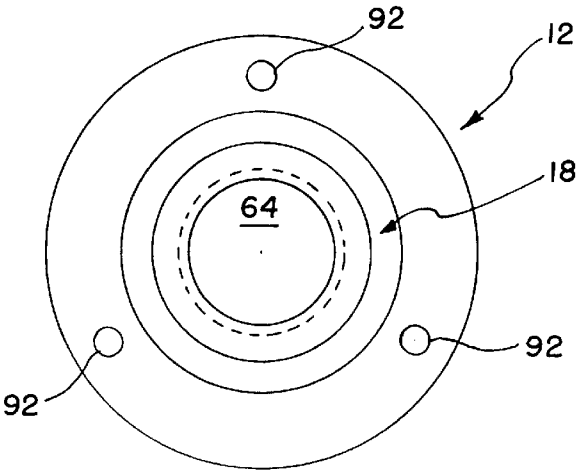
FIG. 5 is a top elevational view of the push rod seal system removed from the tufting machine.

FIG. 5 illustrates a top view of the push rod seal system 12 with the push rod 20 removed. Three orifices 92 are provided in the collar 16 to assist in attaching the push rod seal system 12 to the head 14. As discussed above, other attachment systems may also be utilized to attach the push rod seal system 12 to the head 14.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting machine having a head, a plurality of push rods reciprocably driven in said head, a needle bar carrying a multiplicity of needles reciprocably driven by said push rods, and a push rod seal disposed about a respective push rod, each push rod seal comprising a housing connected to said head, a driver connected to and moveable axially relative to said housing, an annular ledge located within said housing, a plurality of oil seals disposed axially intermediate a portion of said driver and said ledge, a pressure bearing disposed intermediate said driver and said oil seals moveable axially relative to said housing with said driver, at least one of said seals being compressible axially when forcibly moved toward said housing, said push rod seals permitting reciprocatory movement of the respective push rods therethrough.

2. The tufting machine of claim 1 wherein the push rod seals further comprise a locking device, said locking device capable of at least temporarily fixing the position of the driver relative to the housing.

3. The tufting machine of claim 2 wherein the locking device is a screw, said screw extending through a portion of the driver to be in contact with a portion of the housing.

4. The tufting machine of claim 1, wherein the housing further includes a collar and said collar connected to the head of the tufting machine.

5. The tufting machine of claim 1 wherein the driver and said housing have cooperating threads to allow for the driver to move relative to the housing.

6. The tufting machine of claim 5 wherein an exterior portion of the driver contains at least two opposed planar surfaces capable of accepting the jaws of a wrench.

7. The tufting machine of claim 1 wherein the housing further comprises a sleeve portion.

8. The tufting machine of claim 1 wherein at least two different types of oil seals are located intermediate the driver and the ledge.

9. The tufting machine of claim 1 wherein the pressure bushing is located adjacent to said driver.

10. The tufting machine of claim 8 further comprising a female oil seal located adjacent the pressure bushing between the pressure bushing and the ledge.

11. The tufting machine of claim 10 further comprising a male oil seal located adjacent the ledge between the ledge and the pressure bushing.

12. The tufting machine of claim 11 further comprising a female oil seal located between the male oil seal and the pressure bushing.

13. The tufting machine of claim 12 further comprising at least one V-shaped oil seal located between the male and female oil seals.

14. The tufting machine of claim 12 wherein at least one of the at least one V-shaped oil seals is a homogeneous V oil seal constructed of a polyurethane material.

15. In a tufting machine having a head, a mainshaft extending transversely in said head, a driving mechanism connected to said mainshaft, a plurality of push rods connected to and reciprocably driven by said driving mechanism, and a push rod seal disposed about a respective push rod, said push rod seal comprising: a housing connected to said head, a driver connected to and moveable relative to said housing, at least one oil seal capable of being compressed between a portion of said driver and an internal portion of said housing, a pressure bearing disposed intermediate said driver and said at least one oil seal movable axially relative to said housing with said driver, said push rod seals each having an annular bore permitting reciprocatory movement of the push rods therethrough.

* * * * *